US008639154B2

(12) United States Patent
Ishizumi et al.

(10) Patent No.: US 8,639,154 B2
(45) Date of Patent: Jan. 28, 2014

(54) IMAGE FORMING APPARATUS HAVING A CHARGE MEMBER WITH A FOAMED LAYER

(75) Inventors: Keisuke Ishizumi, Mishima (JP); Seiji Saito, Mishima (JP); Tomoo Akizuki, Suntou-gun (JP); Takeshi Shinji, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 236 days.

(21) Appl. No.: 13/088,585

(22) Filed: Apr. 18, 2011

(65) Prior Publication Data

US 2011/0268469 A1 Nov. 3, 2011

(30) Foreign Application Priority Data

Apr. 28, 2010 (JP) ..... 2010-104506

(51) Int. Cl.
*G03G 15/16* (2006.01)

(52) U.S. Cl.
USPC ..... 399/101

(58) Field of Classification Search
USPC ..... 399/101, 129
See application file for complete search history.

(56) References Cited

U.S. PATENT DOCUMENTS

| | | | | |
|---|---|---|---|---|
| 5,587,774 | A * | 12/1996 | Nagahara et al. | 399/176 |
| 5,678,143 | A | 10/1997 | Nagahara et al. | |
| 5,991,566 | A * | 11/1999 | Tanaka et al. | 399/101 |
| 5,999,784 | A * | 12/1999 | Tsukida et al. | 399/297 |
| 6,963,716 | B2 | 11/2005 | Kobayashi et al. | |
| 7,424,254 | B2 | 9/2008 | Akizuki et al. | |
| 7,978,998 | B2 | 7/2011 | Nakagawa et al. | |
| 2009/0232530 | A1 | 9/2009 | Saito et al. | |
| 2010/0290805 | A1 * | 11/2010 | Swantner et al. | 399/101 |
| 2011/0150524 | A1 | 6/2011 | Ishizumi et al. | |

FOREIGN PATENT DOCUMENTS

| | | | |
|---|---|---|---|
| JP | 7-114311 | A | 5/1995 |
| JP | 9-50167 | A | 2/1997 |
| JP | 9-269709 | A | 10/1997 |
| JP | 10-49023 | A | 2/1998 |
| JP | 2009-128459 | A | 6/2009 |
| JP | 2009-205012 | A | 9/2009 |

* cited by examiner

*Primary Examiner* — G. M. Hyder
(74) *Attorney, Agent, or Firm* — Fitzpatrick, Cella, Harper & Scinto

(57) ABSTRACT

An image forming apparatus includes an image bearing member that bears a toner image, and a rotatable and endless intermediate transfer member, wherein a toner image is primarily transferred from the image bearing member to the intermediate transfer member in a first primary transfer part, and a toner image is secondarily transferred from the intermediate transfer member to the image bearing member in a secondary primary transfer part. In addition, a charge member is provided upstream of the first primary transfer part and downstream of the secondary primary transfer part in a rotation direction of the intermediate transfer member to charge residual toner remaining on the intermediate transfer member and not being transferred onto the transfer material in the secondary primary transfer part. The charge member includes a conductive roller whose surface layer is a foamed layer, and in a contact area in which the foamed layer contacts the intermediate transfer member, a space is formed between a part of a surface of the foamed layer and the intermediate transfer member, wherein a size of the space is larger than an average particle size of the residual toner.

15 Claims, 9 Drawing Sheets

IMAGE FORMING APPARATUS HAVING A CHARGE MEMBER WITH A FOAMED LAYER

BACKGROUND OF THE INVENTION

1. Field of the Invention

The present invention relates to image forming apparatuses, such as copying machines and laser printers, that adopt an intermediate transfer system of an electrophotographic system or an electrostatic recording system for transferring a toner image formed on an image bearing member onto an intermediate transfer member and thereafter transferring the toner image onto a transfer material.

2. Description of the Related Art

In an image forming apparatus, part of toner may fail to be transferred from an intermediate transfer member to a transfer material, and this residual toner needs to be cleaned from the intermediate transfer member for the next printing. A proposed method for cleaning the residual toner uses a charge member for charging the residual toner and applies a voltage to the charge member to charge the residual toner to a predetermined polarity. In this method, a primary transfer member then moves the residual toner from the intermediate transfer member to a photosensitive drum.

Japanese Patent Application Laid-Open No. H10-49023 discloses that a roller with electrical conductivity is used as a charge member and provided with a release layer on a front layer thereof by coating or the like, thus suppressing adhesion of residual toner to the conductive roller.

However, in the configuration in Japanese Patent Application Laid-Open No. H10-49023, when a voltage is applied to the conductive roller, a discharge current may be locally generated to break part of the release layer of the conductive roller. Then, an excessive current may flow through the broken part. As a result, the excessive current may flow from the charge member into the intermediate transfer member. Furthermore, if the conductive roller includes the release layer, the conductive roller charges the residual toner in very small spaces located upstream and downstream of a charging nip formed by the conductive roller and intermediate transfer member contacted with each other. Thus, if the amount of the residual toner is large, the residual toner may fail to be sufficiently charged.

SUMMARY OF THE INVENTION

A purpose of the present invention is to provide an image forming apparatus allowing toner to be sufficiently charged while preventing an excessive current from flowing from a charge member into an intermediate transfer member.

Another purpose of the present invention is to provide an image forming apparatus including an image bearing member that bears a toner image, a rotatable and endless intermediate transfer member, a primary transfer member that primarily transfers the toner image from the image bearing member to said intermediate transfer member in a primary transfer part, a secondary transfer member that secondarily transfers the toner image from said intermediate transfer member to a transfer material in a secondary transfer member, and a charge member provided upstream of the primary transfer member and downstream of the secondary transfer member in a rotation direction of the intermediate transfer member to charge residual toner remaining on the intermediate transfer member and not being transferred onto the transfer material in the secondary transfer member, wherein after the charge member charges the residual toner, the primary transfer member moves the residual toner from the intermediate transfer member to the image bearing member, wherein the charge member is a conductive roller that has electrical conductivity and rotates according to rotation of the intermediate transfer member, and the conductive roller includes a foamed front layer and charges the residual toner upstream and downstream of a contact area in which the conductive roller contacts the intermediate transfer member and charges the residual toner in voids formed on the formed layer in the contact area.

A further feature of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention will be described in detail by way of example with reference to the drawings. The sizes, materials, forms, and relative configuration of components described in the following embodiments may be changed as appropriate depending on the configuration and conditions of an apparatus that incorporates the present invention.

First Embodiment

Exemplary Embodiment 1

Figure 1:
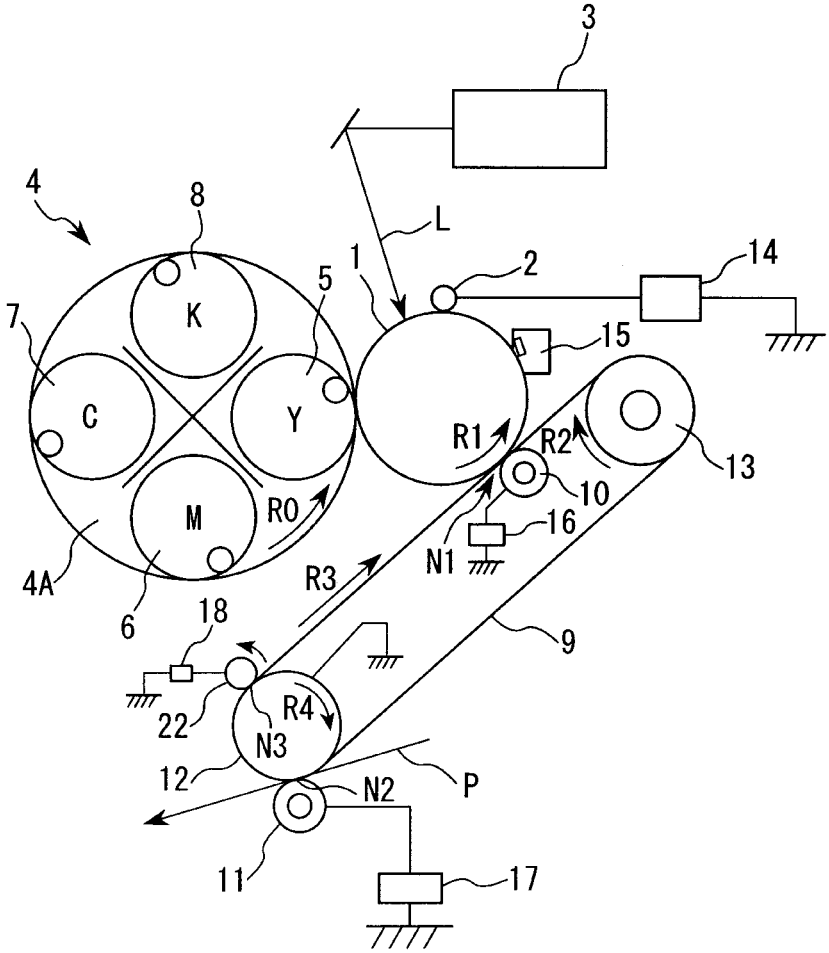
FIG. 1 is a cross-sectional view of a general configuration of an exemplary embodiment of an image forming apparatus according to the present invention.

FIG. 1 is a schematic diagram illustrating an exemplary embodiment of an image forming apparatus according to the present invention.

The image forming apparatus according to the present exemplary embodiment is of an electrophotographic type using an intermediate transfer scheme. In the image forming apparatus, toner images in a plurality of colors are sequentially superimposed on one another on an intermediate transfer member making a plurality of rotations. Then, a secondary transfer member transfers the toner images onto a transfer material all at once.

In the present exemplary embodiment, the image forming apparatus includes a photosensitive drum 1 serving as an image bearing member and borne so as to be rotatable. A charging device 2 serving as an image bearing charging roller, an exposure unit 3, and a developing unit 4 are arranged around the photosensitive drum 1. Moreover, an intermediate transfer belt 9, a primary transfer roller 10, and a cleaning part 15 are arranged around the photosensitive drum 1; the intermediate transfer belt 9 is a belt-like intermediate transfer member, and the primary transfer roller 10 is a primary transfer member. Furthermore, a secondary transfer roller 11 serving as a secondary transfer member is arranged around the intermediate transfer belt 9 so as to be able to come into contact with and detach from the intermediate transfer belt 9. In the present exemplary embodiment, the developing unit 4 includes developing devices 5, 6, 7 and 8 and a rotary 4A serving as a rotatable support member supporting the developing devices 5, 6, 7 and 8.

Moreover, the image forming apparatus includes a DC voltage power supply part 16 configured to apply DC voltages of positive polarity and negative polarity to the primary transfer roller 10 and a DC voltage power supply part 17 configured to apply DC voltages of positive polarity and negative polarity to the secondary transfer roller 11. Additionally, the image forming apparatus includes a charge member arranged therein and which can come into contact with and detach from the intermediate transfer belt 9. The charge member is arranged downstream of the secondary transfer roller 11 and upstream of the primary transfer roller in the direction of rotation of the intermediate transfer belt 9. The charge member is a conductive roller 22 shaped like a roller and includes a DC voltage power supply part 18 configured to apply DC voltages of positive polarity and negative polarity to the conductive roller 22.

The DC voltage power supply part 16 can apply voltages within the range of −2000 V to +2500 V. The DC voltage power supply parts 17 and 18 can apply voltages within the range of −2000 V to +4000 V.

Furthermore, in coming into contact with the intermediate transfer belt 9, the secondary transfer roller 11 and the conductive roller 22 rotate in conjunction with driving by the intermediate transfer belt 9 and in the same direction as that in which the intermediate transfer belt 9 rotates.

The photosensitive drum 1 is driven in the direction of arrow R1 by a driving part (not shown in the drawings) and evenly charged to a negative potential by the charging roller 2.

Then, the photosensitive drum 1 is irradiated, by the exposure unit 3, with laser light L based on image information to form a latent image thereon. The latent image is developed by any one of the developing devices 5, 6, 7 and 8 to form a single-color toner image of negative polarity. The single-color toner image on the photosensitive drum 1 is transferred to the intermediate transfer belt 9. Single-color toner images formed as described above are superimposed on one another on the intermediate transfer belt to form a multicolor toner image. The multicolor toner image is transferred to a transfer material P all at once.

As described above, in the present exemplary embodiment, the developing unit 4 configured to visualize the latent images on the photosensitive drum 1 includes the four developing devices 5, 6, 7 and 8 configured to develop yellow Y, magenta M, cyan C and black K, respectively. The developing devices 5, 6, 7 and 8 are mounted in the rotary 4A. Rotating the rotary 4A in the direction of arrow R0 allows the developing devices 5, 6, 7 and 8 to move sequentially to a position where the developing device comes into contact with the photosensitive drum 1. Then, the yellow Y, magenta M, cyan C and black K are developed in this order.

The intermediate transfer belt 9 serving as an intermediate transfer member is tensioned around tension rollers 12 and 13 and can be rotated in the direction of arrow R3. The intermediate transfer belt 9 includes an endless belt formed of resin and having a surface resistance of $5.0\times10^{10}\Omega/\square$, a volume resistance of $2.0\times10^{11}$ Ωm, a relative permittivity of 3, and a thickness of 100 μm. The intermediate transfer belt 9 is in contact with the photosensitive drum 1 and is rotated by a driving motor (not shown in the drawings) in the direction of R3 at the same peripheral speed as that of the photosensitive drum 1. The surface resistance of the intermediate transfer belt 9 was measured by Hirester MP-CHT450 manufactured by Mitsubishi Chemical Analytech Co., Ltd.

The primary transfer roller 10 serving as a primary transfer member is arranged opposite the photosensitive drum 1 across the intermediate transfer belt 9, that is, the primary transfer roller 10 is arranged at a primary transfer member N1. A voltage of a positive polarity is applied to the primary transfer roller 10 to primarily transfer toner images formed on the photosensitive drum 1 onto the intermediate transfer belt 9.

In the above-described steps, the four colors, the yellow Y, magenta M, cyan C and black K are primarily transferred onto the intermediate transfer belt 9 so as to be sequentially superimposed on one another. Then, a toner image in the plurality of colors is formed on the intermediate transfer belt 9. While the yellow Y, magenta M and cyan C are being primarily transferred, the secondary transfer roller 11 arranged at a secondary transfer member N2 is detached from the intermediate transfer belt 9 and thus prevented from coming into contact with the toner image on the intermediate transfer belt 9 to disturb the image. Similarly, the conductive roller 22 is detached from the intermediate transfer belt 9 and thus prevented from coming into contact with the toner image on the intermediate transfer belt 9 to disturb the image; the conductive roller 22 is arranged downstream of the secondary transfer member N2 and upstream of the primary transfer member N1 in the direction of movement of the intermediate transfer belt 9. After the cyan is primarily transferred and the trailing end of the image passes through the conductive roller 22, the secondary transfer roller 11 and the conductive roller 22 are brought into contact with the intermediate transfer belt 9. A DC voltage with the positive polarity is then applied to the secondary transfer roller 11 and the conductive roller 22.

After the secondary transfer roller 11 comes into contact with the intermediate transfer belt 9, the transfer material P is conveyed by a sheet feeding roller. The transfer material P is fed to a secondary transfer member where the secondary transfer roller 11 comes into contact with the intermediate transfer belt 9, that is, the secondary transfer nip portion N2, at a predetermined timing. A DC voltage of positive polarity is applied to the secondary transfer roller 11 to allow a multicolor toner image to be secondarily transferred from the intermediate transfer belt 9 to the transfer material P. After the transfer material P passes through the secondary transfer nip portion N2, the DC voltage applied to the secondary transfer roller 11 and the conductive roller 22 is interrupted. After the interruption, the secondary transfer roller 11 and the conductive roller 22 are detached from the intermediate transfer belt 9.

The transfer material P having passed through the secondary transfer nip portion N2 is conveyed to a fixation part (not shown in the drawings). The fixation part fixes the toner image on the transfer material P, which is then discharged and conveyed as an image formed article (print or copy).

If images are consecutively formed, then after the primary transfer of the black is finished, the yellow in the right next image is primarily transferred. Thus, the above-described image forming process is repeated.

Residual toner remaining on the intermediate transfer belt 9 instead of being secondarily transferred to the transfer material P is charged to positive polarity by the conductive roller 22. Then, simultaneously with the primary transfer of the yellow in the next image, the residual toner is moved to the photosensitive drum 1. Finally, the residual toner is collected by the cleaning part 15 on the photosensitive drum 1. The residual toner need not be moved simultaneously with the primary transfer but may be moved at any other timing. Alternatively, the residual toner may be exclusively moved.

Now, a procedure for collecting the residual toner on the intermediate transfer belt 9 will be described.

In the present embodiment, the regular polarity of toner housed in the developing devices 5, 6, 7 and 8 is negative. Thus, the toner remaining on the intermediate transfer belt 9 after the secondary transfer mostly has negative polarity. Since the DC voltage of positive polarity for the primary transfer is applied to the primary transfer roller 11, the residual toner maintaining negative polarity cannot be collected on the photosensitive drum 1.

Thus, a DC voltage of about 2500 V and of positive polarity is applied to the conductive roller 22 to charge the residual toner to positive polarity.

Now, the conductive roller 22 will be described.

Figure 2:
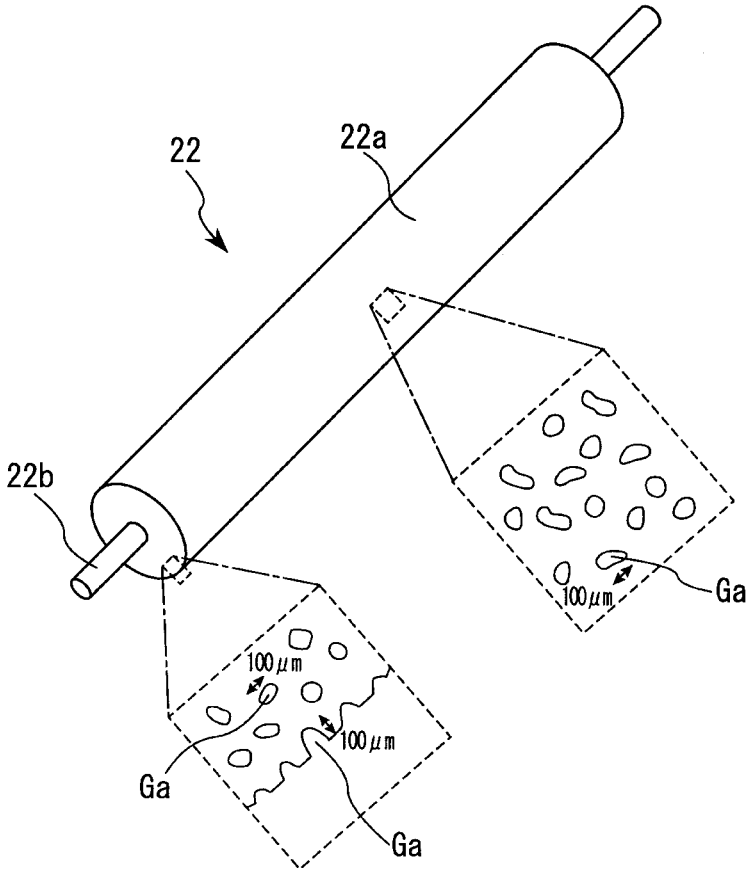
FIG. 2 is a perspective view illustrating a general configuration of a conductive roller.

As illustrated in FIG. 2, the conductive roller 22 is a rubber roller formed using NBR and hydrin as main compounds. A cored bar 22*b* is passed through a central portion of the rubber roller 22*a*. The rubber roller 22*a* is 9.5 mm in diameter, and the core bar 22*b* is 5 mm in diameter. Furthermore, as illustrated in FIG. 2, voids Ga are formed in a front layer of the rubber roller and inside the rubber roller as a result of foaming. The shape of the voids Ga varies but is adjusted such that the voids Ga have circular cross sections and are about 100 μm in diameter. The width of the void is hereinafter defined as the length from the end to end of the cross section of the void. The rubber roller has a resistance value of $3.15\times10^{7}\Omega$ and a hardness of 53 degrees (Asker C hardness).

Figure 3:
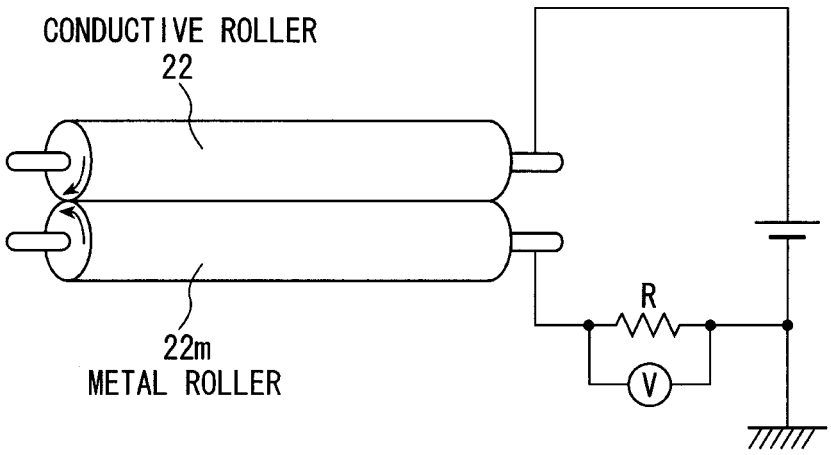
FIG. 3 is a schematic diagram of resistance measuring circuit configured to measure the resistance of the conductive roller.

FIG. 3 is a diagram illustrating the configuration of a circuit configured to measure the resistance of the conductive roller 22. The resistance value was calculated by measuring the potentials V of points located upstream and downstream of a resistor R in FIG. 3 which potentials were obtained when the conductive roller 22 with a voltage applied thereto was brought into contact with a metal roller 22*m* being rotationally driven.

The image forming apparatus according to the present exemplary embodiment includes pressurization mechanisms (not shown in the drawings) provided at the respective opposite ends of the conductive roller 22. When the conductive roller 22 comes into contact with the intermediate transfer belt 9, the conductive roller 22 is pressurized at the opposite ends thereof under a predetermined force. When coming into contact with the intermediate transfer belt 9, the conductive roller 22 may be pressurized to the degree that the conductive roller 22 is rotated in conjunction with rotation of the intermediate transfer belt 9. That is, the conductive roller 22 is rotated in the same direction as that in which the intermediate transfer belt rotates. Furthermore, a pressure contact portion N3 between the conductive roller 22 and the intermediate transfer belt 9 may have a width of about 0.5 mm to 2.0 mm so that a discharge current can be efficiently generated in the voids formed upstream and downstream of the pressure contact portion N3. To meet these conditions, the conductive roller 22 may have a hardness of about 45° to 60° (Asker C hardness) and may be subjected to a total pressurization force of about 3.0 N to 10 N.

In the present exemplary embodiment, the conductive roller 22 has a hardness of 53 degrees and is pressurized at the opposite ends thereof under a force of about 1.5 N. Thus, the pressure contact portion N3 is about 0.5 mm in width.

Moreover, to charge the residual toner, the DC voltage power supply part 18 applies a voltage of about 2500 V to the conductive roller 22.

Now, a method for manufacturing the conductive roller 22 will be described.

In the steps of manufacturing the conductive roller 22, first, a rubber component containing a mixture of a main rubber component, a foaming agent and a vulcanizing agent is shaped like a hollow cylinder by an extrusion molding machine and cut into a specified size.

Then, the rubber component cut into the specified size is placed in a pressurization furnace, in which the rubber component is foamed and vulcanized. Controlling the temperature, pressure and pressurization time of the pressurization furnaces allows adjustment of the size of the voids formed in and on the front layer of rubber component and inside the rubber component as a result of foaming.

In Exemplary Embodiment 1, the voids were adjusted to have a width of about 100 μm. After the rubber component is placed in the pressurization furnace, the treated rubber component is further placed in an electric furnace for vulcanization. Thus, a part of the rubber component which has failed to be vulcanized is completely vulcanized.

Then, the rubber component shaped like a hollow cylinder (rubber roller) 22*a* produced as described above is press-fitted over the core bar 22*b* with an adhesive applied thereto. After the press-fitting, the rubber component 22*a* is heated in the electric furnace to melt the adhesive.

Finally, the rubber is cut at the opposite ends thereof to a specified size. Moreover, the surface of the rubber component (rubber roller) 22*a* is polished to a specified outer diameter. Thus, the conductive roller 22 is completed.

Now, charging of the residual toner will be described.

Figure 4A:
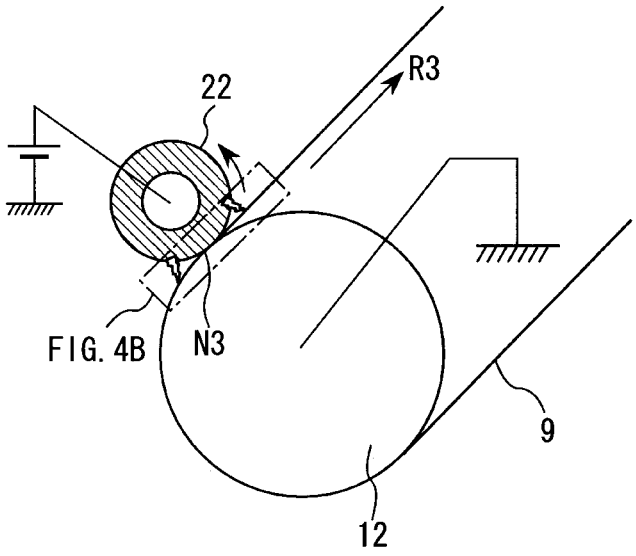
FIG. 4A is a diagram illustrating a general configuration of surroundings of the conductive roller.
Figure 4B:
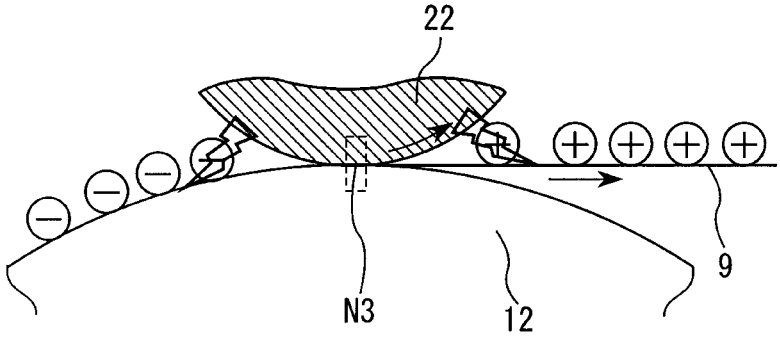
FIG. 4B is a diagram illustrating how toner is charged by a discharge current generated near a pressure contact portion between the conductive roller and an intermediate transfer belt.

As shown in FIGS. 4A and 4B, the residual toner is charged by passage, through the residual toner, of a discharge current generated between the conductive roller 22 and the intermediate transfer belt 9 when a DC voltage is applied to the conductive roller 22. Thus, the conductive roller 22 needs to be configured to efficiently generate a discharge current when the DC voltage is applied to the conductive roller 22.

The discharge current is generated when a very small space has a potential difference of at least a given value. Since the conductive roller 22 is shaped like a roller, very small spaces are formed between the conductive roller 22 and the intermediate transfer belt 9 and upstream and downstream of the pressure contact portion N3, the area in which the conductive roller 22 and the intermediate transfer belt 9 contact each other. As shown in FIG. 4B, discharge occurs in the very small spaces located upstream and downstream of the pressure contact portion N3 to charge the residual toner on the intermediate transfer belt 9.

Figure 5:
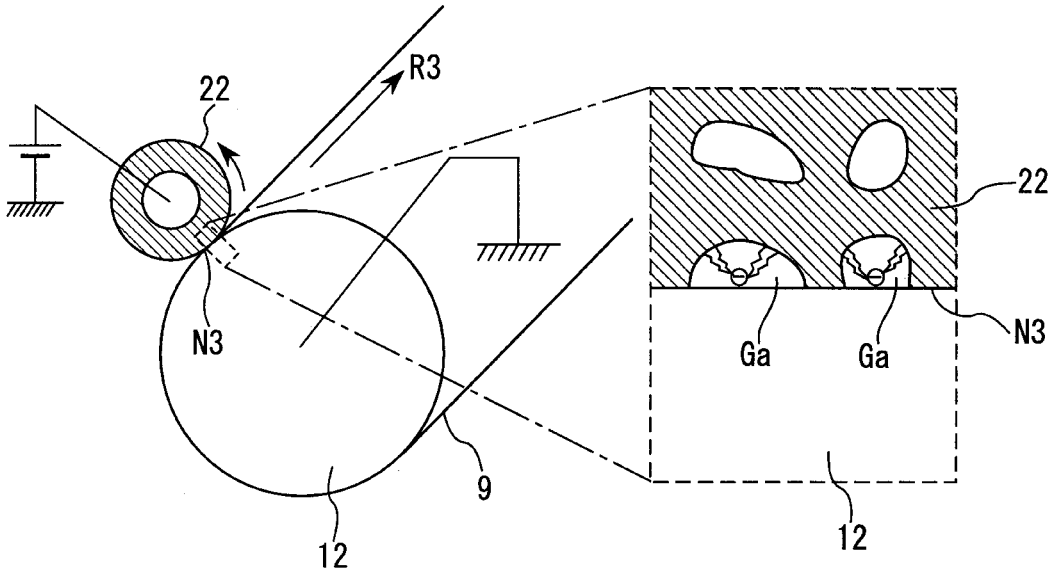
FIG. 5 is a diagram illustrating how toner is charged in the pressure contact portion between the conductive roller and the intermediate transfer belt.

Furthermore, the conductive roller 22 involves voids Ga of about 100 μm formed in the area of the pressure contact portion N3 as a result of foaming. Thus, a discharge current is also generated in the area of the pressure contact portion N3. The reason is as follows. The toner used in the present exemplary embodiment is about 5 μm in particle size and is sufficiently small compared to the void, which is 100 μm in width. Hence, in the pressure contact portion N3, the residual toner is contained in the voids as shown in FIG. 5 and charged by a discharge current generated in the voids Ga.

Furthermore, local flow of a discharge current damaged not only the intermediate transfer belt 9 but also the release layer of the conductive roller 22A.

In contrast, in the configuration of the conductive roller 22 according to Exemplary Embodiment 1, a discharge current is also generated in the pressure contact portion N3 to allow the toner to be charged by application of 2500 V. Thus, the intermediate transfer belt 9 is protected from damage. Additionally, since the release layer is not provided, there is no possibility of damaging the release layer.

For Exemplary Embodiment 1 and the Comparative Example Table 1 illustrated below indicates charging of the toner and damage to the intermediate transfer belt observed when voltages are applied to the conductive roller.

TABLE 1

| | 2000 V | | 2500 V | | 3000 V | | 3500 V | |
|---|---|---|---|---|---|---|---|---|
| Voltage applied to conductive roller | Toner charging | Belt damage | Toner charging | Belt damage | Toner charging | Belt damage | Toner charging | Belt damage |
| Exemplary Embodiment 1 (voids in front layer) | FAIR | No damage | PASS | No damage | PASS | No damage | PASS | Belt damaged |
| Comparative example (no void + release layer) | FAIL | No damage | FAIR | No damage | PASS | Belt damaged | PASS | Belt damaged |

PASS . . . Residual toner was sufficiently positively charged and appropriately collected on the photosensitive drum.

FAIR . . . Residual toner was positively charged and mostly collected on the photosensitive drum, but a small amount of toner failed to be collected.

FAIL . . . Only part of the residual toner was successfully positively charged, and much of the residual toner failed to be collected on the photosensitive drum.

Thus, if voids Ga are formed in the front layer of the conductive roller 22, a discharge current is generated not only in the spaces located upstream and downstream of the pressure contact portion N3 but also in the pressure contact portion N3. Hence, the toner can be efficiently charged.

Now, a comparative example will be described in which the conductive roller 22 includes a release layer provided in the front layer of the non-foamed conductive roller and configured to prevent the toner from adhering to the conductive roller.

Figure 6:
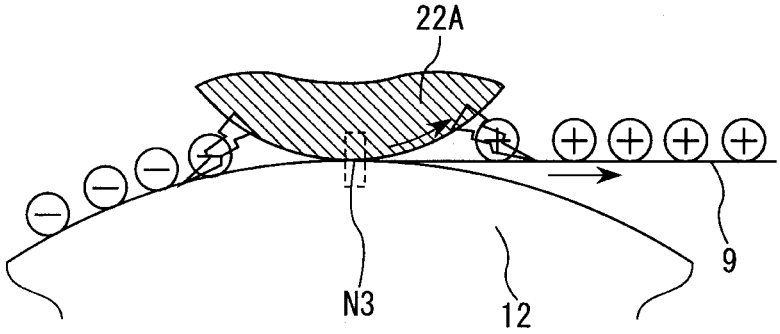
FIG. 6 is a diagram illustrating how toner is charged by the conductive roller in a comparative example.

FIG. 6 is a diagram illustrating how discharging occurs in the conductive roller in the comparative example. As illustrated in FIG. 6, without foaming, no voids are formed in the front layer of the conductive roller 22A. Thus, no discharge current is generated in the pressure contact portion N3. The residual toner is charged and discharged only in the spaces located upstream and downstream of the pressure contact portion N3.

As a result, the toner cannot be charged in the pressure contact portion N3 but only in voids located close to the pressure contact portion N3. Thus, in the comparative example, a sufficient discharge current to charge the toner failed to be obtained even by applying a 2500 VDC to the conductive roller 22 as is the case with Exemplary Embodiment 1.

Thus, in the comparative example, an increased voltage needs to be applied to the conductive roller 22A. A voltage of 3000 V needed to be applied in order to sufficiently charge the toner. However, if a voltage of as high as 3000 V is applied, the toner is charged by a discharge current generated in the voids located close to the pressure contact portion N3 but a large amount of discharge current locally flows. Hence, the intermediate transfer belt 9 and the release layer of the conductive roller 22A may be damaged. Accordingly, the voltage applied to the conductive roller 22A needed to be less than 3000 V.

In the comparative example, when a voltage of at least 3000 V was applied to the conductive roller 22A, the toner was sufficiently charged, whereas the intermediate transfer belt 9 was damaged.

In contrast, the conductive roller 22 according to Exemplary Embodiment 1 can be sufficiently charged to the toner by application of a voltage of at least 2500 V. Furthermore, areas where a discharge current is generated are dispersed, and the intermediate transfer belt 9 is more unlikely to be damaged than in the conventional art.

Figure 7:
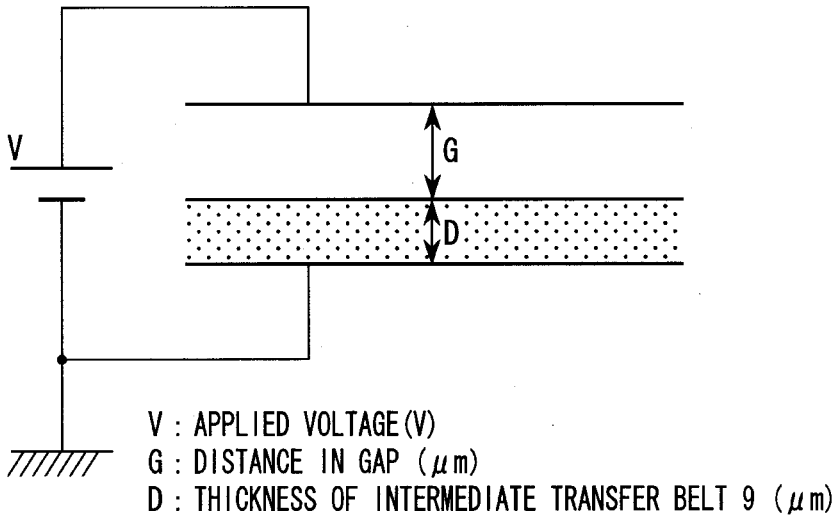
FIG. 7 is a diagram schematically illustrating how the circuit works when a discharge current is generated by a recess and protrusion structure in a front layer of the conductive roller.

The potential of the surface of the conductive roller 22 was calculated using such a model of discharge in voids as shown in FIG. 7, in order to verify that a discharge current was generated in the pressure contact portion N3. The surface potential of the conductive roller 22 is determined by:

$$Vs=(\in G\times V)/(\in G+D) \quad (1)$$

In Expression (1), the voltage applied to the conductive roller 22 is denoted by V, and the dielectric constant of the intermediate transfer belt 9 is denoted by ∈. The size of the voids (the gap in FIG. 7) is represented by G, and the thickness of the intermediate transfer belt 9 is denoted by D. Expression (1) is used to determine the potential of the front layer of the conductive roller 22 obtained when the size of the voids is varied at each applied voltage since the dielectric constant and thickness of the intermediate transfer belt 9 are constant.

In the present exemplary embodiment, the intermediate transfer belt 9 has a dielectric constant ∈ of 3 and a thickness D of 100 μm. A discharge current is generated when the potential in Expression (1) is higher than a discharge threshold potential.

Figure 8:
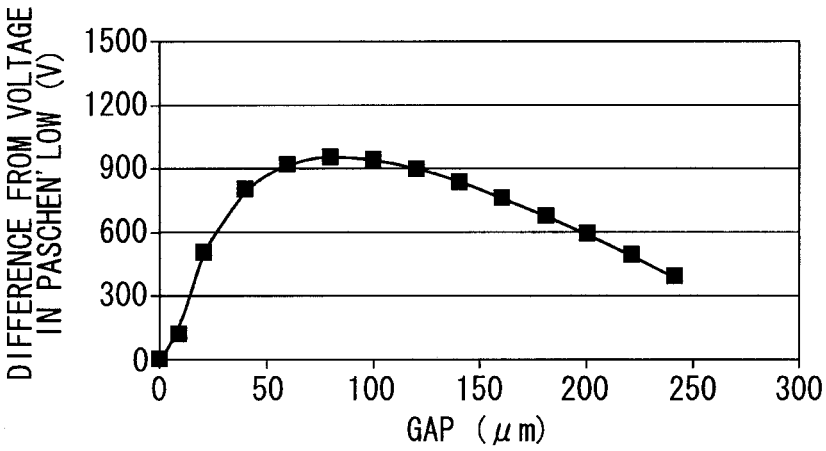
FIG. 8 is a diagram illustrating a difference between the potential of the surface of the conductive roller and a Paschen potential.

FIG. 8 illustrates the difference between the potential of the surface of the conductive roller 22 determined by Expression (1) and the discharge start potential determined based on the Paschen's Law when the voltage applied to the conductive roller 22 is 2500 V. The amount of discharge current increases consistently with the value of the difference.

FIG. 8 indicates that no discharge current is generated when the voids are 0 μm in size and that the amount of discharge current increases consistently with the size of the voids, with the amount of discharge current generated reaching a peak when the voids are about 80 μm in size. When the voids are at least 80 μm in size, the amount of discharge current generated decreases gradually with increasing void size.

The discharge current is generated as follows. Accidental electrons in the air are accelerated by an electric field generated between electrodes. The electrons collide against air molecules and are repeatedly ionized and excited. Then, the number of the electrons increases in geometric progression. Thus, if almost no void is generated, the probability that electrons collide against air molecules is low, making a discharge current unlikely to be generated. Furthermore, excessively large voids contribute to reducing the magnitude of the electric field generated between the electrodes. This prevents the electrons from being accelerated, with no discharge current generated.

Therefore, with optimum voids, a discharge current can be efficiently generated.

The graph in FIG. 8 varies depending on the voltage applied to the conductive roller 22, the dielectric constant ∈ of the intermediate transfer belt 9, and the thickness D. Thus, a variation in any of these values varies the void size with which the amount of dielectric current generated reaches a peak. However, the actual dielectric constant ∈ of the intermediate transfer belt 9 is within the range of about 3 to 9. The thickness D is within the range of about 50 μm to 150 μm in terms of the handling ability during assembly and flexibility. These ranges of the dielectric constant ∈ and the thickness D allow a sufficient discharge current to be generated when the voids are about 50 μm to 200 μm in size and are thus advantageous for charging of the toner.

To check whether or not a discharge current was actually generated, measurement was carried out to determine how the amount of current flowing from the conductive roller 22 changed when the size of the voids in the conductive roller 22 was changed.

The current was measured using a circuit similar to that illustrated in FIG. 3. The current value was calculated by measuring the potential across the resistor R illustrated in FIG. 3.

Figure 9:
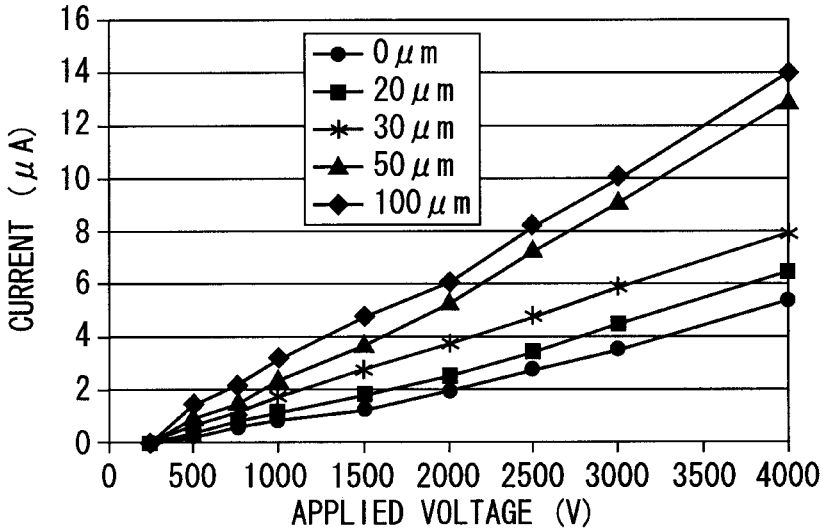
FIG. 9 is a graph illustrating the results of current measurement carried out when the size of voids is varied.

In FIG. 9, the axis of abscissas indicates the voltage applied to the conductive roller 22. The axis of ordinate indicates the current. Comparison was made among the cases where the voids formed between the conductive roller 22 and the metal roller 22*m* by a recess and protrusion structure in the front layer of the conductive roller 22 were 0 μm, 20 μm, 40 μm, 50 μm and 100 μm, respectively, in size.

FIG. 9 indicates that when the size was 50 μm and 100 μm, a discharge current was efficiently generated in the pressure contact portion N3. Thus, when the size of the voids is one of 50 μm and 100 μm, more current is generated with the same applied voltage than when the size of the voids is 30 μm. Thus, the voids in the front layer of the conductive roller 22 are desirably set to at least 50 μm in size in order to efficiently generate a discharge current in the pressure contact portion N3.

On the other hand, an increase in void size increases the intervals among the areas where a discharge current is generated, resulting in uneven charging of the toner.

Table 2 indicates the results of checks obtained by examining how the residual toner was collected on the photosensitive drum when a variation was made in the size of the voids and in the voltage applied to the conductive roller.

TABLE 2

| | | Applied voltage (V) | | | |
|---|---|---|---|---|---|
| | | 2000 | 2500 | 3000 | 3500 |
| Void (μm) | 350 | FAIL | FAIL | FAIL | FAIL |
| | 300 | FAIL | FAIR | PASS | PASS |
| | 250 | FAIL | FAIR | PASS | PASS |
| | 200 | FAIL | PASS | PASS | PASS |
| | 100 | FAIR | PASS | PASS | PASS |
| | 50 | FAIR | PASS | PASS | PASS |

PASS . . . Residual toner was appropriately collected on the photosensitive drum.
FAIR . . . Residual toner was almost appropriately collected on the photosensitive drum.
FAIL . . . Much of the residual toner failed to be collected on the photosensitive drum.

When the voids are at most 300 μm in size, the residual toner can be more appropriately collected by increasing the voltage applied to the conductive roller 22. In contrast, when the voids are 350 μm in size, the residual toner is unevenly charged in association with the pattern of the voids in the front layer of the conductive roller 22. Thus, the toner fails to be appropriately collected regardless of the applied voltage. The reason is as follows: even with an increase in applied voltage and thus in the amount of discharge current generated, the excessively large voids contribute to increasing the intervals among the areas where a discharge current is generated, causing the residual toner to be unevenly charged. Discharging allows part of the toner to be sufficiently charged. However, another part of the toner is completely uncharged. As a result, the charged residual toner is collected on the photosensitive drum 1, whereas the uncharged toner fails to be collected on the photosensitive drum 1 and remains on the intermediate transfer belt 9. Thus, the voids are desirably at most 300 μm in size.

That is, as understood from the above description, the size of the voids Ga may be at least 50 μm and at most 300 μm.

As described above, in Exemplary Embodiment 1, the voids Ga were formed in the front layer of the conductive roller 22 to allow a discharge current to be generated in the pressure contact portion N3 between the conductive roller 22 and the intermediate transfer belt 9. This enabled the toner to be also charged in the pressure contact portion N3. As a result, the toner was successfully charged by applying, to the conductive roller 22, a voltage of 2500 V, which is lower than that in the conventional art. This enabled an excessive current to be prevented from flowing from the conductive roller 22 into the intermediate transfer belt.

Exemplary Embodiment 2

In Exemplary Embodiment 2, a method for more effectively charging the residual toner using the conductive roller 22 will be described. The present exemplary embodiment is particularly effective on a case where the residual toner includes at least two layers.

Figure 10:
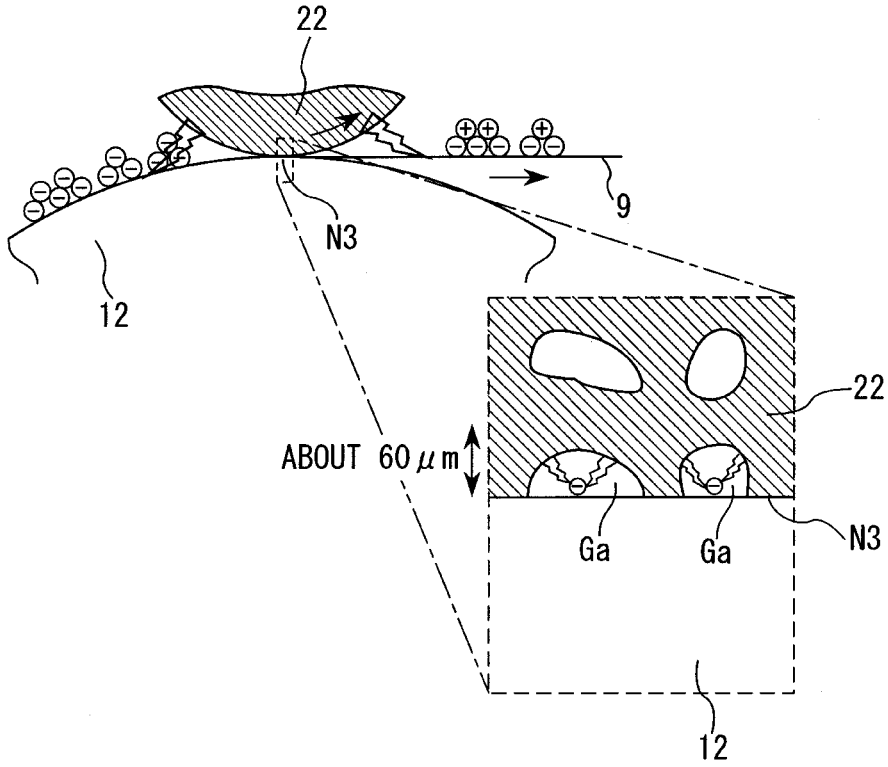
FIG. 10 is a diagram schematically illustrating that residual toner formed of at least two layers is charged.

As illustrated in FIG. 10, if the residual toner includes at least two layers, when the configuration according to Exemplary Embodiment 1 is used to charge the residual toner, a discharge current generated by the conductive roller 22 charges only the front-layer residual toner. The front-layer residual toner charged to positive polarity is collected on the photosensitive drum 1. However, the under-layer toner maintains negative polarity. The under-layer toner thus fails to be collected on the photosensitive drum 1 and remains on the intermediate transfer belt 9.

The toner remaining on the intermediate transfer belt 9 is transferred from the surface of the intermediate transfer belt 9 to the transfer material P during the next image formation, resulting in an inappropriate image.

As described above, if the residual toner includes at least two layers, the evenness of charging of the residual toner varies between the front layer and the under layer. This may prevent part of the residual toner from being collected on the photosensitive drum 1. To allow all of the residual toner to be collected on the photosensitive drum 1, the residual toner needs to be evenly charged to positive polarity. To allow the residual toner to be evenly charged, the toner may be dispersed into one layer before passing through the conductive roller 22.

Figure 11:
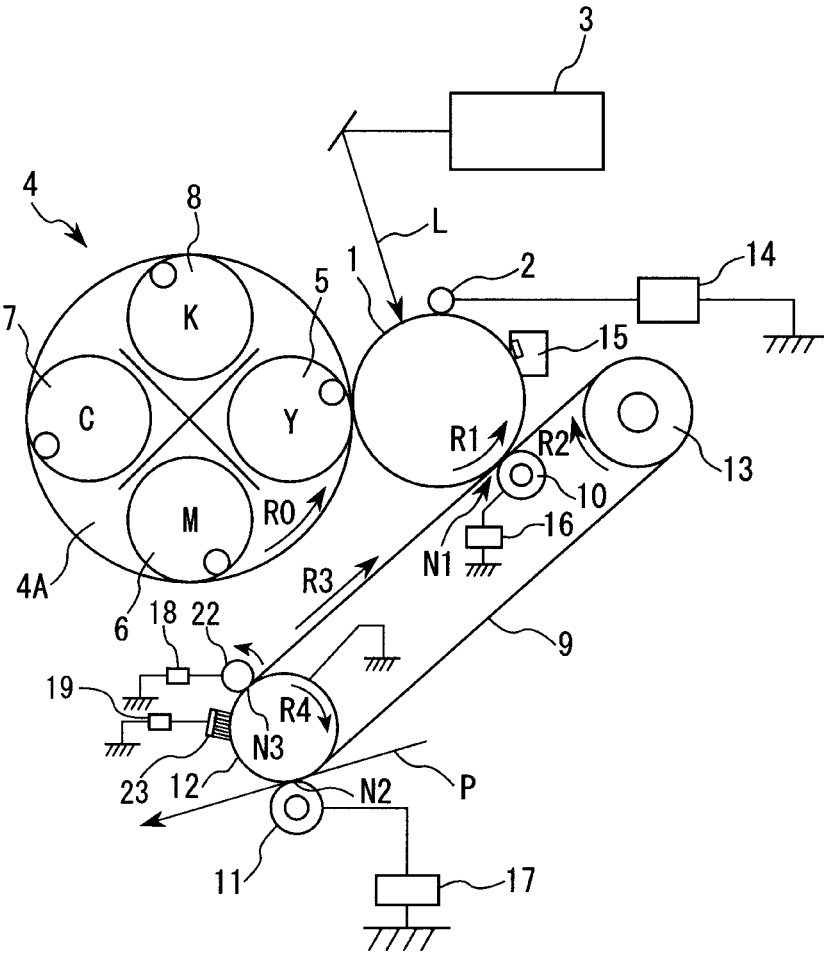
FIG. 11 is a diagram illustrating a general configuration of another exemplary embodiment of the image forming apparatus according to the present invention.

Thus, in Exemplary Embodiment 2, to disperse the residual toner into one layer, the apparatus includes a conductive brush 23 arranged upstream of the conductive roller 22 and downstream of the secondary transfer roller 11 and serving as a slidable rubbing member configured to come into contact with and detach from the intermediate transfer belt 9 in conjunction with the conductive roller 22, as illustrated in FIG. 11. The apparatus further includes a DC voltage power supply part 19 arranged therein to apply DC voltages of the positive and negative polarities to the conductive brush 23. An image forming process according to the present exemplary embodiment is similar to that in Exemplary Embodiment 1.

The conductive brush 23 is formed of conductive nylon fibers with a fiber diameter about 20 μm and a density such that about 120 fibers are woven per 1 $mm^2$.

Figure 12:
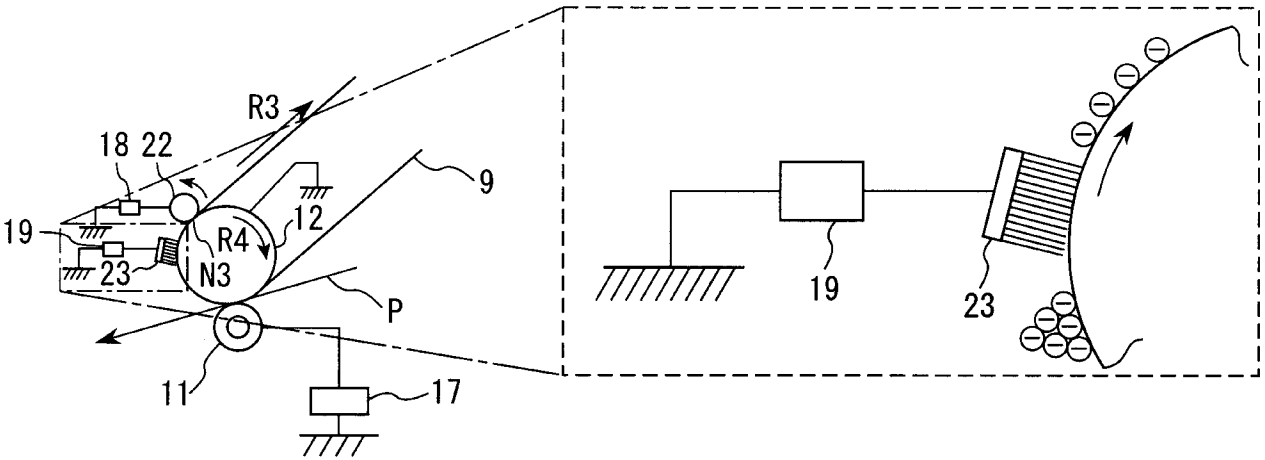
FIG. 12 is a diagram illustrating that residual toner including at least two layers is dispersed into one layer by a conductive brush 23.

Since the fibers with a fiber diameter similar to the particle size of the toner are densely woven, the residual toner formed of at least two layers is swept off and dispersed into one layer upon passing through the conductive brush 23, as illustrated in FIG. 12. Furthermore, the conductive brush 23 with a DC voltage of positive polarity applied thereto enables the residual toner to be charged to positive polarity.

After passing through the conductive brush 23, the residual toner passes through the conductive roller 22. A DC voltage of positive polarity has been applied to the conductive roller 22 as is the case with the Exemplary Embodiment 1. Thus, the residual toner is charged to positive polarity by a discharge current generated in the voids located close to the pressure contact portion N3 between the conductive roller 22 and the intermediate transfer belt 9. The residual toner dispersed into one layer by the conductive brush 23 is evenly subjected to the discharge current and thus evenly charged to positive polarity.

Furthermore, the residual toner is charged to positive polarity by a discharge current generated in the voids Ga in the pressure contact portion N3 which are located in the front layer of the conductive roller 22. Also in this case, the residual toner, dispersed into one layer, is efficiently charged to positive polarity.

As is the case with Exemplary Embodiment 1, the residual toner charged to positive polarity upon passing through the conductive roller 22 is reversely transferred to the photosensitive drum 1, while at the same time the yellow in the next image is primarily transferred. The residual toner is finally collected on the photosensitive drum 1 by the cleaning part 15.

As described above, Exemplary Embodiment 2 uses the conductive brush 23 to disperse the residual toner formed of at least two layers into one layer so as to allow the residual toner to be efficiently charged to positive polarity by the conductive roller 22. Then, the conductive brush 23 sweeps and disperses the residual toner into one layer, which is then charged by the conductive roller 22.

Even if the residual toner is formed of at least two layers, the configuration according to the present exemplary embodiment allows the residual toner to be efficiently charged to positive polarity by a discharge current generated in the voids located close to the pressure contact portion N3 between the conductive roller 22 and the intermediate transfer belt 9 and by a discharge current generated in the voids Ga in the pressure contact portion N3 which are located in the front layer of the conductive roller 22. Thus, the residual toner is reliably collected on the photosensitive drum 1.

Furthermore, the conductive brush 23 is used to disperse the residual toner into one layer. However, applying a DC voltage of positive polarity to the conductive brush 23 not only enables the function to disperse the residual toner into one layer but also allows the residual toner to be partly charged to positive polarity. Therefore, the whole residual toner can be more efficiently charged to positive polarity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-104506, filed Apr. 28, 2011, which is hereby incorporated by reference herein in its entirety.

What is claimed is:

1. An image forming apparatus comprising:

an image bearing member that bears a toner image;

a rotatable and endless intermediate transfer member, wherein a toner image is primarily transferred from the image bearing member to the intermediate transfer member in a first primary transfer part, and a toner image is secondarily transferred from the intermediate transfer member to a transfer material in a secondary primary transfer part;

a charge member provided upstream of the first primary transfer part and downstream of the secondary primary transfer part in a rotation direction of the intermediate transfer member to charge residual toner remaining on the intermediate transfer member and not being transferred onto the transfer material in the secondary primary transfer part;

wherein the charge member includes a conductive roller whose surface layer is a foamed layer, and in a contact area in which the foamed layer contacts the intermediate transfer member, a space is formed between a part of a surface of the foamed layer and the intermediate transfer member, wherein a size of the space is larger than an average particle size of the residual toner.

2. An image forming apparatus according to claim 1, further comprising a power supply part that supplies only DC voltage to the conductive roller.

3. An image forming apparatus according to claim 1, wherein voids are formed in a foaming of the foamed layer and have sizes that are equal to or more than 50 μm and equal to or less than 300 μm.

4. An image forming apparatus according to claim 3, wherein the sizes of the voids are larger than an average particle size of the residual toner.

5. An image forming apparatus according to claim 4, wherein the voids have a size that is ten to forty times of a size of the residual toner.

6. An image forming apparatus according to claim 4, wherein the conductive roller follows movement of the intermediate transfer member.

7. An image forming apparatus according to claim 1, wherein the foamed layer of the conductive roller is formed by shaping a rubber component mixed with a foaming agent and then foaming the foaming agent, and a void in the conductive roller is formed by foaming of the foaming agent.

8. An image forming apparatus according to claim 1, further comprising a conductive brush provided upstream of the conductive roller and downstream of the secondary transfer member to disperse the residual toner.

9. An image forming apparatus according to claim 8, further comprising a power supply part that applies only DC voltage to the conductive brush.

10. An image forming apparatus according to claim 1, wherein the residual toner charged by the conductive roller is moved from the intermediate transfer member to the image bearing member at a timing when the first primary transfer member primarily transfers the toner image from the image bearing member to the intermediate transfer member.

11. An image forming apparatus according to claim 1, wherein the charge member discharges in the space and charges the residual toner remaining in the space.

12. An image forming apparatus according to claim 1, wherein after the charge member charges the residual toner, toner moves from the intermediate transfer member to the image bearing member.

13. An image forming apparatus according to claim 1, wherein the first primary transfer part includes a primary transfer member opposing the image bearing member through the intermediate transfer member, with the primary transfer member configured to primarily transfer the toner image from the image bearing member to the intermediate transfer member.

14. An image forming apparatus according to claim 1, wherein the secondary transfer part has a secondary transfer member contacting the intermediate transfer member, with the secondary transfer member configured to secondarily transfer the toner image from the intermediate transfer member to the transfer material.

15. An image forming apparatus according to claim 1, wherein a discharge current is generated at upstream and downstream locations of the contact area and in the space at the contact area.

* * * * *